US005664556A

United States Patent [19]

Byers

[11] Patent Number: 5,664,556

[45] Date of Patent: Sep. 9, 1997

[54] FIREPLACE REFLECTOR

[76] Inventor: Thomas L. Byers, 5480 Stewart Dr., Mustang, Okla. 73064

[21] Appl. No.: 619,972

[22] Filed: Mar. 20, 1996

[51] Int. Cl.[6] ..... F24B 1/195

[52] U.S. Cl. ..... 126/553; 126/500; 126/552; 160/135; 160/378

[58] Field of Search ..... 126/553, 552, 126/500; 160/135, 378

[56] References Cited

U.S. PATENT DOCUMENTS 3,994,275 11/1976 Williams ..... 126/552
4,194,490 3/1980 Crnkovic ..... 126/553

*Primary Examiner*—Larry Jones
*Attorney, Agent, or Firm*—Dougherty, Hessin, Beavers & Gilbert

[57] ABSTRACT

A reflector screen for a fireplace consisting of a rectangular central screen of reflective material hingedly interconnected with first and second side panels of reflective material for placement in the rear of a fireplace in surround of the fire.

3 Claims, 2 Drawing Sheets

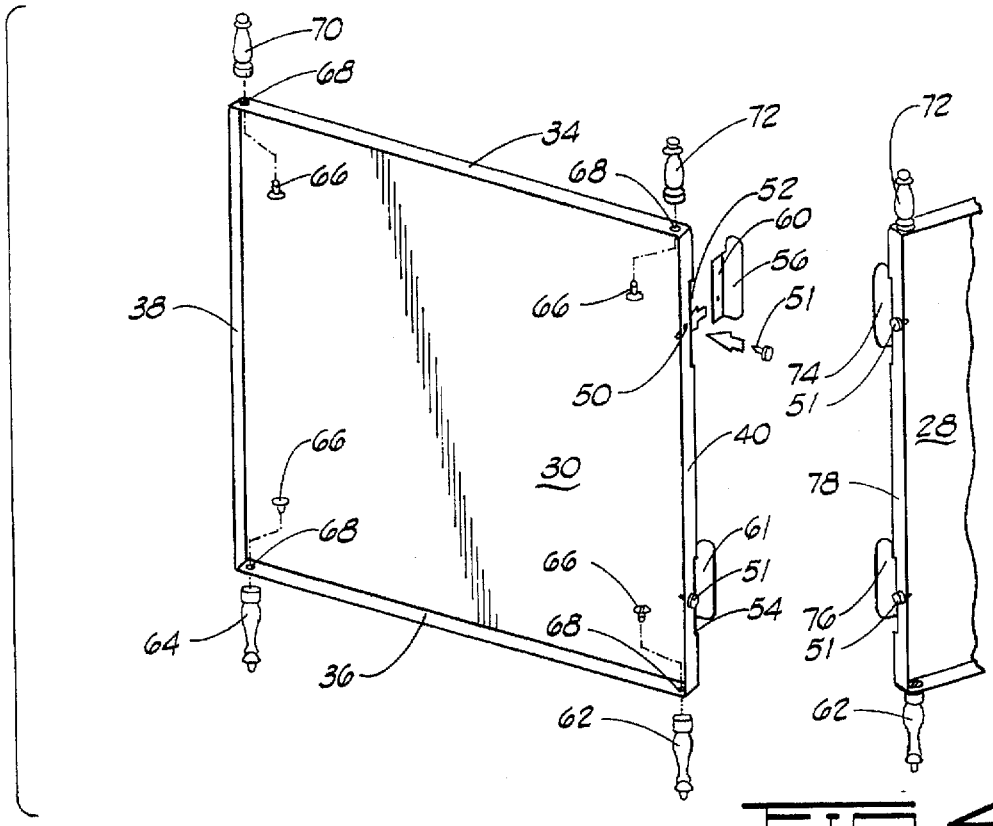
FIG. 4
FIG. 3
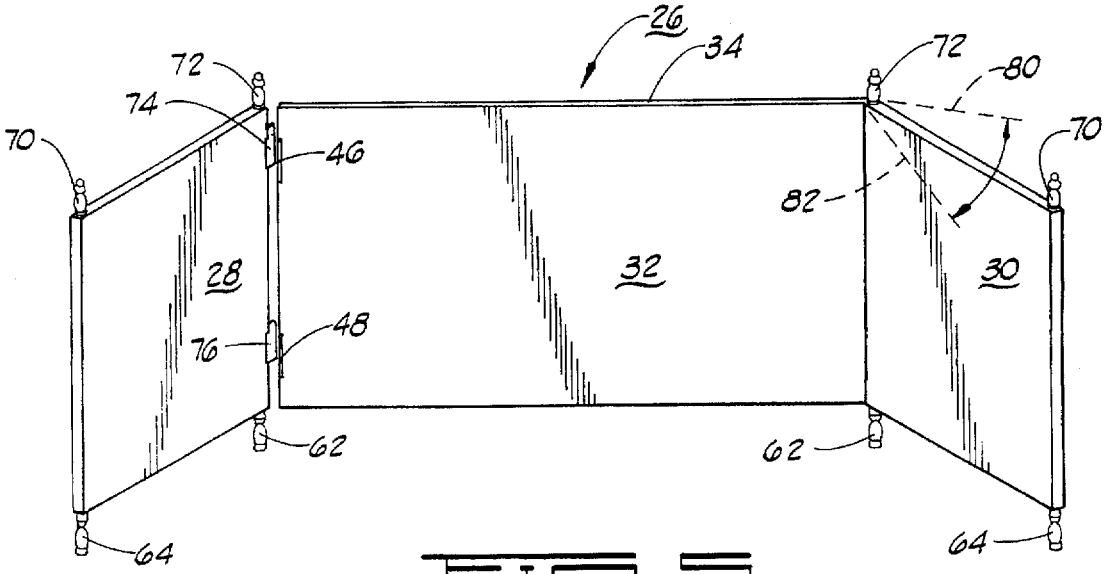
FIG. 5

FIREPLACE REFLECTOR

BACKGROUND OF THE INVENTION

1. Field of the Invention

The invention relates generally to fireplace reflectors of the type for installation in a fireplace to effect forward reflection of heat generated in the fireplace.

2. Description of the Prior Art

In general, the reflective characteristics of a fireplace are those that are built-in to the back wall. That is, qualities of reflection as enhanced by such measures as brick color, glazed surfaces and the like are built-in considerations when constructing a fireplace. The present invention contemplates a manually placed reflector screen that enables adjustability of heat direction and focus.

SUMMARY OF THE INVENTION

The present invention relates to a heat reflection screen for placement behind a fire in a fireplace. The screen consists of a plurality of sheet metal panels which are hingedly connected together for surrounding placement behind a fire source, i.e., either a wood fire or gas-fired log assembly. First and second side panels each include decorative legs attached along the bottom edge and serving to support the side panels in position with approximately a two to three inch clearance therebeneath. A central panel is then hingedly connected to each of the side panels so that it too has the requisite clearance space relative to the hearth surface.

Therefore, it is an object of the present invention to provide a manually placeable reflector screen for use in maximizing fireplace heat.

It is also an object of the invention to provide such a reflection screen that is easily maintained and attractive in operation.

It is yet further an object of the present invention to provide a reflection screen that can be used in combination with existing andiron structures, gas pipes, etc.

Finally, it is an object of the present invention to provide a reflection screen that may be easily set up and adjusted for focus of heat.

Other objects and advantages of the invention will be evident from the following detailed description when read in conjunction with the accompanying drawings that illustrate the invention.

BRIEF DESCRIPTION OF THE DRAWINGS

FIG. 3 is a rear side perspective view of a side panel with parts shown exploded;

FIG. 4 is a partial rear side perspective view of the opposite side panel; and

FIG. 5 is a perspective view of the assembled reflector screen with one side panel shown disconnected.

DETAILED DESCRIPTION OF THE INVENTION

Figure 1:
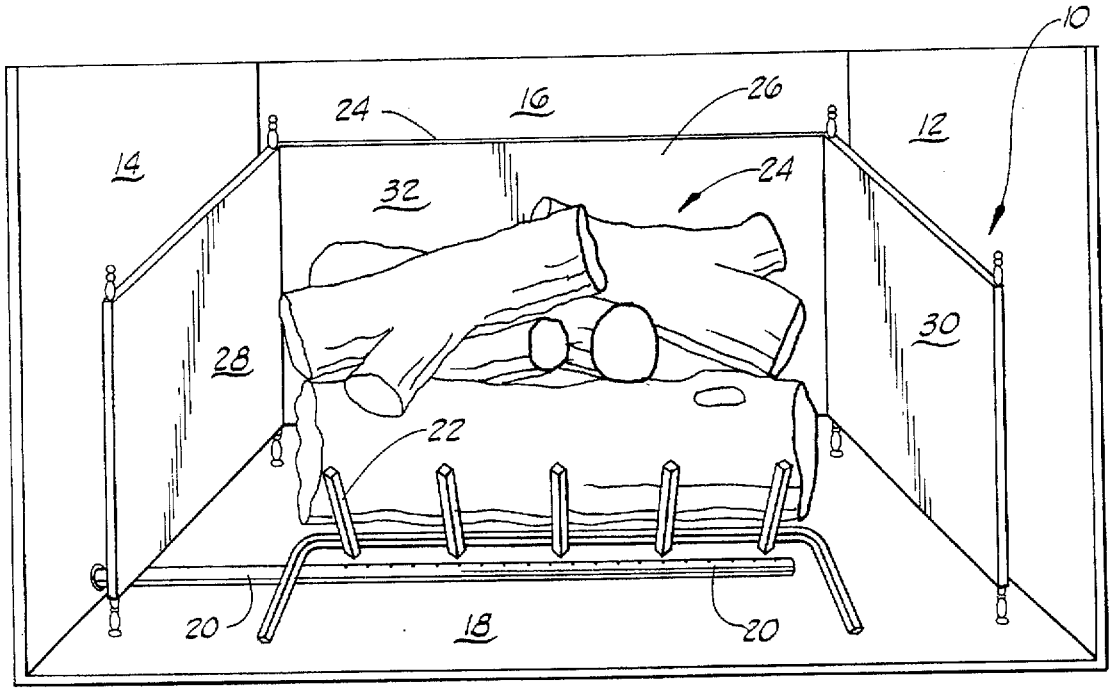
FIG. 1 is a front perspective view of a reflector screen operatively disposed in a fireplace.

FIG. 1 illustrates a well-known form of fireplace 10 having canted side walls 12 and 14, back wall 16 and hearth surface 18. The fireplace 10 includes a gas pipe 20 extending transverse and closely along hearth 18 beneath the grate structure 22 (or andirons) and a stack of fuel logs 24. A reflector screen 26 having opposite side panels 28 and 30 and rear panel 32 is then arrayed around the rear edge of fireplace 10 behind the log stack 24. Log stack 24 may be natural wood logs or they may be the ceramic gas log elements, depending upon what the user prefers.

The side panels 28 and 30 are hingedly connected to opposite sides of the rear panel 32 so that the side panels 28 and 30 pivot in the fireplace corners and adjust to fit the particular fireplace shape. Also, the angular positioning of side panels 28 and 30 enables an increase in heating efficiency by adjustment to reflect the maximum radiant energy outward from the fireplace 10. The heat reflector 10 redirects heat, lost rearward from the fire and normally absorbed by the fireplace back walls, to radiate the heat forward into the room at optimum concentration.

Figure 2:
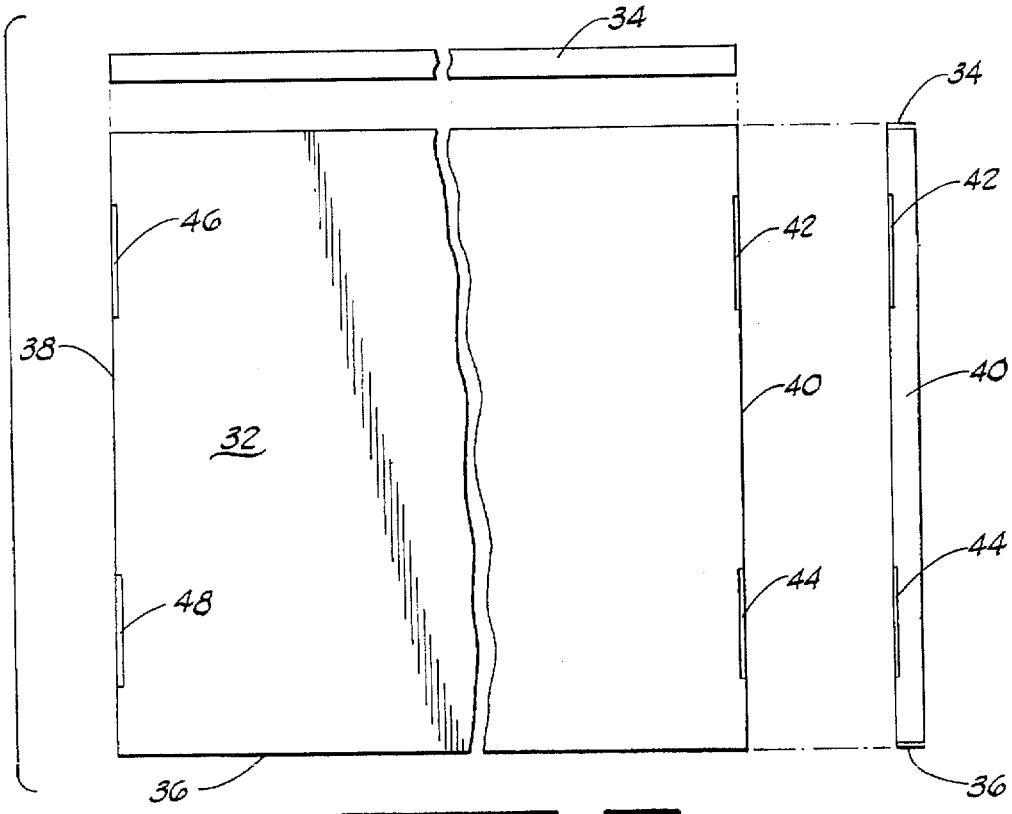
FIG. 2 is a view in side elevation of a screen central panel showing top view and side view in association.

Referring to FIG. 2, the rear panel 32 would be typically constructed from 0.020 or 0.030 inch sheet metal which is stiffened by right angle bent sides such as top side 34 and bottom side 36, while opposite side bends 38 and 40 provide similar stiffening in the opposite dimension. The central panel 32 includes upper and lower slots 42 and 44 on one side of the panel 32 closely adjacent the side 40, and the opposite side of panel 32 includes upper and lower slots 46 and 48 closely adjacent the side 38. The panels 28, 30 and 32 may be formed from aluminum, stainless steel or other reflective materials such as Everbrite® lighting sheet, an anodized aluminum, which is available from Southco Metal Services, Inc. of Norcross, Ga.

FIG. 3 illustrates the side panel 30 (from the rear side). It should be understood that side panels 28 and 30 are of identical but mirror image construction as they interconnect from a left hand and right hand connection to central panel 32. In FIG. 3, the bent side 40 of panel 30 includes upper and lower slots 52 and 54 for receiving upper connector tab 56 and lower connector tab 61 therein. The connector tabs are right angle bent tabs having a right angle insert 60 which inserts through respective slots 52 and 54 for securing by means of a self-tapping screw 51 through holes 50. Each of the hanger tabs 56 and 61 can then be inserted through respective upper and lower slots 46 and 48 of central panel 32 to support the central panel thereon. Opposite corner support posts 62 and 64 may be secured along the bottom edge strip 36 by means of self-tapping screws or similar fasteners 66 via holes 68. The support legs 62 and 64 may be decorative brass turnings as may also the top decorative spires 70 and 72 as secured by fasteners 66 through hole 68.

Referring to FIG. 4, the opposite side panel 28 is of mirror-image construction as it has upper and lower hanger tabs 74 and 76 secured in bent side 78 by means of fasteners 51. Also, the side panel 28 includes the decorative top knobs 72 and support leg 62 and their opposite side counterparts (not shown).

Referring now to FIG. 5, the partially assembled reflector screen 26 is shown with the side panel 30 connected to the central panel 32. That is, the connector tabs 56 and 61 have been inserted through edge slots 42 and 44 of central panels 32 in support of the central panel 32 as the legs 62 and 64 support the combination. Thereafter, the opposite side panel 28 may be joined by inserting connector tabs 74 and 76 through edge slots 46 and 48, respectively, of central panel 32 whereupon both sides of central panel 32 are then suspended and supported by side panel legs 62 and 64 on both sides. The side panels 28 and 30 may be adjusted to a wide variance of angle as indicated by dash-lines 80 and 82 and the optimum reflectance characteristics may easily be adjusted into the reflector panel combination.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A heat reflector screen for use in a fireplace behind the fire, comprising:

a rectangular central panel of reflective metal having hanger slots on each side, each central panel side being folded at a ninety degree angle to provide panel stiffener approximately one-half inch wide;

first and second generally square side panels of reflective metal having hanger tabs on one side for insertion through said hanger slots to support hingedly said central panel, each side panel side being folded at a ninety degree angle to provide panel stiffener approximately one-half inch wide; and first and second support legs disposed on each of said first and second side panels to provide a pre-determined vertical clearance for said reflector screen.

2. A heat reflector screen as set forth in claim 1 wherein:

the central panel and first and second side panels are stainless steel.

3. A heat reflector screen as set forth in claim 1 wherein:

said central panel and first and second side panels are aluminum with anodized aluminum oxide coating.

* * * * *